US011745509B2

(12) United States Patent
Elaarag et al.

(10) Patent No.: US 11,745,509 B2
(45) Date of Patent: Sep. 5, 2023

(54) INK-JET PRINTING MODULE FOR PRINTING ROBOT, MAGAZINE FOR THESE MODULES, AND INK-JET PRINTING METHOD USING THIS ROBOT

(71) Applicant: WESTLAKE COMPOUNDS HOLDING, Reims (FR)

(72) Inventors: Hossam Elaarag, Reims (FR); Christophe Aliaga, Juillan (FR); Mustapha El Fouzari, Reims (FR); Nicolas Amouroux, Reims (FR)

(73) Assignee: WESTLAKE COMPOUNDS HOLDING, Reims (FR)

( * ) Notice: Subject to any disclaimer, the term of this patent is extended or adjusted under 35 U.S.C. 154(b) by 344 days.

(21) Appl. No.: 17/277,029

(22) PCT Filed: Sep. 25, 2019

(86) PCT No.: PCT/FR2019/052247
§ 371 (c)(1),
(2) Date: Mar. 17, 2021

(87) PCT Pub. No.: WO2020/065208
PCT Pub. Date: Apr. 2, 2020

(65) Prior Publication Data

US 2022/0032630 A1 Feb. 3, 2022

(30) Foreign Application Priority Data

Sep. 28, 2018 (FR) ..... 1801014

(51) Int. Cl.
*B41J 2/175* (2006.01)

(52) U.S. Cl.
CPC ..... *B41J 2/17506* (2013.01); *B41J 2/17553* (2013.01)

(58) Field of Classification Search
CPC ..... B41J 2/03; B41J 2/17503; B41J 2/17506; B41J 2/17509; B41J 2/1752;
(Continued)

(56) References Cited

U.S. PATENT DOCUMENTS 4,842,475 A * 6/1989 Driels ..... B25J 9/0084 414/730
7,965,055 B2 * 6/2011 Koike ..... B23K 9/12 318/566

FOREIGN PATENT DOCUMENTS

DE 102017202195 A1 9/2017
EP 2644392 A2 10/2013
(Continued)

*Primary Examiner* — Anh T Vo
(74) *Attorney, Agent, or Firm* — Leason Ellis LLP

(57) ABSTRACT

Inkjet printing module (1) capable of being picked up by the arm (111) of a robot (101), characterized in that said module includes: a print head (2); an ink reservoir (3) capable of supplying ink to said print head (2); compressed-gas supply means (4) capable of suppling compressed gas to said print head (2); a mechanical interface (7) capable of engaging removably with a complementary mechanical interface (107) of a robot arm; an electronic interface (6) capable of engaging removably with an electronic interface (106) of said robot arm in order to transfer data between said module and the robot; and at least one fluid interface (5) placed in fluid communication with the compressed-gas supply means or with the ink reservoir.

19 Claims, 8 Drawing Sheets

(58) Field of Classification Search
CPC ..... B41J 2/17553; B41J 25/34; B41J 29/02;
B25J 9/06; B25J 17/0283
See application file for complete search history.

(56) References Cited

FOREIGN PATENT DOCUMENTS

| | | | |
|---|---|---|---|
| EP | 2887011 | A1 | 6/2015 |
| EP | 3290166 | A1 | 3/2018 |
| WO | 99/47356 | A1 | 9/1999 |
| WO | 03/006247 | A1 | 1/2003 |
| WO | 2009/047510 | A1 | 4/2009 |
| WO | 2009/088864 | A1 | 7/2009 |
| WO | 2013/158310 | A2 | 10/2013 |
| WO | 2017/190897 | A1 | 11/2017 |
| WO | 2018/060823 | A1 | 4/2018 |

* cited by examiner

INK-JET PRINTING MODULE FOR PRINTING ROBOT, MAGAZINE FOR THESE MODULES, AND INK-JET PRINTING METHOD USING THIS ROBOT

CROSS-REFERENCE TO RELATED PATENT APPLICATIONS

This application is a U.S. National Stage Application under 35 U.S.C. § 371 of International Patent Application No. PCT/FR2019/052247, filed Sep. 25, 2019, which claims the benefit of priority of French Patent Application number 1801014 filed Sep. 28, 2018, both of which are incorporated by reference in their entireties. The International Application was published on Apr. 2, 2020, as International Publication No. WO 2020/065208 A1.

TECHNICAL FIELD OF THE INVENTION

The present invention relates to the field of inkjet printing techniques for depositing inks or varnishes onto a surface of industrial parts, in particular on surfaces which are not flat. The purpose of this printing is typically for decoration, protection or functionalization of industrial parts. More particularly, the invention relates to a device and a method for inkjet printing on a surface of industrial parts of decimetric or metric size, using a multi-axis robot.

PRIOR ART

Stylish decoration of visible surfaces is becoming increasingly important in many fields. This is particularly the case in the automotive sector. Nowadays, consumers can design their cars increasingly individually, choosing from a growing range of technical and aesthetic options. This concerns in particular the decoration of visible surfaces inside the passenger compartment.

To respond to this customization trend, special vinyl inks and robotic digital printers capable of printing on curved surfaces, molds or parts, in particular for the decoration of dashboards, door panels and other parts made of molded PVC, intended in particular for automobile passenger compartments, have been developed. This positioned-printing technology makes it possible to print accurately and in color on any type of substrate for the customization thereof.

Movable functional blocks provided with an inkjet print head are already known. These blocks can be mounted on a robot arm, according to the teaching in particular of DE 10 2017 202 195 (Heidelberger Druck-maschinen), EP 3 290 166 (Boeing) and EP 2 887 011 (Hexagon Technology Center). In these arrangements, the inkjet print heads are fed directly by a flexible hose. Similarly, EP 2 644 392 (Heidelberger Druckmaschinen) describes an inkjet print head block which is capable of printing on a curved surface and is fed by a data connection and an ink supply hose.

These known solutions have certain drawbacks, however.

They require the use of numerous supply means connecting the robot and the print head. These supply means, which are in particular fluid supply hoses and power supply cables, are likely to impede the movements of the robot. In addition, data transmission to the print head may require a data line. In any case, the presence of these supply and electronic connection means involves additional assembly and maintenance time when changing the print head. WO 2013/158 310 (Kateeva Inc.) describes a unit including a plurality of inkjet print heads mounted on a gantry which moves the heads in two main orthogonal directions above a planar table. This system may be suitable for printing on a flat surface, but is very complex.

In view of the above, the present invention aims to remedy at least some of the above-mentioned drawbacks of the prior art. In particular, it aims to provide an inkjet printing system which can easily be manipulated by a robot arm having a plurality of axes, allowing precise printing on curved surfaces of industrial parts having a dimension which may exceed one meter, and allowing decoration using a plurality of inks.

Subjects of the Invention

According to the invention, at least one of the above aims is achieved by an inkjet printing module capable of being picked up by the arm of a robot via a quick-coupling mechanical interface, characterized in that said module includes:

- a print head;
- an ink reservoir capable of supplying ink to said print head;
- compressed-gas supply means capable of supplying compressed gas to said print head;
- a mechanical interface capable of engaging removably with a complementary mechanical interface of a robot arm;
- an electronic interface capable of engaging removably with an electronic interface of said robot arm in order to transfer data between said module and the robot; and
- at least one fluid interface placed in fluid communication with the ink reservoir and/or with the compressed-gas supply means.

The invention relates firstly to this module.

Said compressed-gas supply means may include, or may be, an internal compressed-gas reservoir that is integrated into said printing module, or may be represented by the connecting pipes between the print head and the fluid interface, said fluid interface being connected, when the printing module is in a printing configuration, to an external compressed-gas supply.

The printing module according to the invention may include control lines extending between the electronic interface and, respectively, the print head and the ink reservoir. Another optional control line can extend between the fluid interface and the compressed-gas supply means.

The printing module according to the invention may include one or two connecting pipes extending between the fluid interface and/or, respectively, the ink reservoir and the compressed-gas supply means.

The presence of a mechanical interface on said module facilitates its quick connection with the complementary mechanical interface of the robot, which is capable of engaging with the mechanical interface of the module. The presence of an ink reservoir makes the inkjet printing module self-contained for a particular period of time.

The invention also relates to a robot for inkjet printing, including a robot arm, characterized in that said robot arm includes:

- a complementary quick-coupling mechanical interface capable of engaging with the quick-coupling mechanical interface of an inkjet printing module according to the invention; and
- a complementary electronic interface capable of engaging with the electronic interface of an inkjet printing module according to the invention.

The robot according to the invention can in particular be a five- or six-axis robot. It can include a central processing unit, as well as at least one control line connecting this central processing unit and the complementary electronic interface.

The invention also relates to a magazine for inkjet printing modules that is capable of accommodating, docked thereon, a plurality of inkjet printing modules according to the invention, said magazine including:

- a plurality of docking stations for an inkjet printing module, each docking station including at least one complementary fluid interface capable of engaging with the fluid interface of an inkjet printing module according to the invention in order to transfer ink between the head and the docking station and/or to supply compressed gas to the head; as well as
- at least one complementary mechanical interface capable of engaging with the mechanical interface of an inkjet printing module according to the invention.

This magazine can include at least one compressed-gas supply, which may be a compressed-gas tank. It can include at least one ink tank.

This magazine allows inkjet printing modules to be refilled with ink and compressed air. It facilitates the use of a plurality of modules, which modules differ in nature or in the color of the ink, in order to decorate the same part or the same set of parts.

The magazine according to the invention may include all or some of the following features, insofar as they are technically compatible:

- each docking station is provided with a particular ink tank;
- said ink tanks are filled with inks or varnishes of different types;
- each station further includes at least one complementary electronic interface capable of engaging with the electronic interface of an inkjet printing module according to the invention;
- each station includes a compressed-gas supply, which may be in particular a compressed-gas reservoir or a hose connected to an external compressed-gas supply;
- each station includes a frame containing said at least one ink tank and/or said at least one compressed-gas tank;
- the magazine includes a movable assembly provided with said complementary mechanical interface and, where appropriate, with said complementary fluid interface and/or with said complementary electronic interface;
- said movable assembly includes a carriage capable of being moved relative to the frame in a first direction, in particular a horizontal direction, as well as a connection block capable of being moved relative to the carriage in a second direction, in particular a vertical direction, said connection block being provided with said complementary mechanical interface and, where appropriate, with said complementary fluid interface and/or with said complementary electronic interface; and
- each station further includes an immobilization flange extending from the frame (310), said flange and the frame defining a volume for receiving a module, said flange and/or the frame being provided with means for immobilizing said module.

The invention also relates to an inkjet printing assembly, including a robot according to any of the embodiments of the invention, a magazine according to any of the embodiments of the invention, as well as at least one module according to any of the embodiments of the invention. Advantageously, the mechanical interface and the complementary mechanical interface define a removable quick coupling, in particular of the quarter-turn type.

The invention lastly relates to an inkjet printing method, including the following steps:

(i) picking up an inkjet printing module which is located in a docking station of a magazine that can contain a plurality of said modules, said picking up being carried out by means of engagement between said complementary mechanical interface of the robot and said mechanical interface of said module;

(ii) connecting the complementary electronic interface of said robot with the electronic interface of said module;

(iii) moving the robot arm to a print surface;

(iv) printing ink on said surface by moving the robot arm, in one or more passes, said module being controlled by data sent thereto by way of said electronic interface and said complementary electronic interface;

(v) at the end of this printing sequence, moving the robot arm to a docking station; and (vi) depositing the print head in said docking station, disconnecting said electronic and mechanical interfaces.

Said method may include the following additional steps:

(vii) moving the robot arm to another docking station; and (viii) performing steps (i) to (vi) using another inkjet print head located in this docking station.

Said magazine may be a magazine according to the invention. Said robot may be a robot according to the invention.

The term "ink" here encompasses varnishes, for example transparent varnishes, semi-transparent varnishes, colored varnishes, protective varnishes (anti-scratch, anti-abrasion, anti-UV, etc.).

The method according to the invention may include at least one of the following technical features, insofar as they are technically compatible with the other steps:

- said ink reservoir of the module is refilled with ink by connecting the fluid interface of said module and the complementary fluid interface of said station;
- the ink printing step (iv) is carried out using a first module while at least one other module is being refilled; and
- different modules are refilled using inks or varnishes of different types.

Finally, the invention relates to the use of the method according to the invention for printing on surfaces that are curved in at least one main direction. Said curved surface may be a visible surface of a trim part of an automobile passenger compartment.

DESCRIPTION OF THE FIGURES

Other advantages of the invention will become apparent on reading the description of two embodiments of the invention, given below purely by way of illustration and not being limiting, with reference to the accompanying drawings, in which:

FIG. 1(*b*) shows an alternative embodiment of FIG. 1(*a*) that differs only in the absence of the compressed-gas reservoir.

FIG. 12(*b*) shows an enlargement of an area shown in FIG. 12(*a*).

Figure 1A:
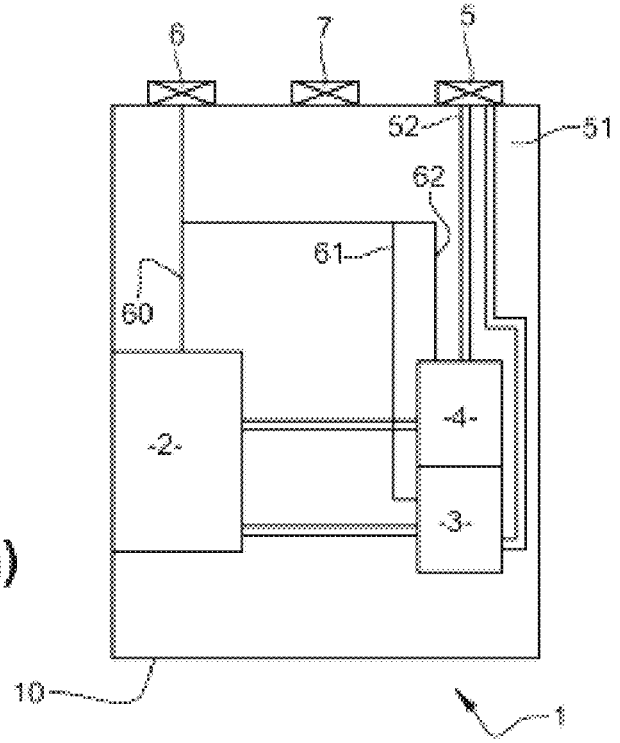
FIG. 1 comprises two schematic views, showing an inkjet printing module according to the invention, belonging to an inkjet printing assembly.

The following reference signs are used in the drawings:

| | |
|---|---|
| 1 | Printing module |
| 2 | Print head |
| 3 | Ink reservoir |
| 4 | Compressed-gas reservoir |
| 5 | Fluid interface |
| 6 | Electronic interface |
| 7 | Mechanical interface |
| 31 | Channel for the ink |
| 41 | Channel for the compressed gas |
| 51 | Channel for the ink |
| 52 | Channel for the compressed gas |
| 60 | Control line |
| 61 | Control line |
| 62 | Control line |
| 101 | Robot |
| 106 | Complementary electronic interface |
| 107 | Complementary mechanical interface |
| 108 | Complementary fluid interface |
| 110 | Body of the robot 101 |
| 111 | Gripper arm |
| 140 | Compressed-gas tube |
| 160 | Control line |
| 161 | Central processing unit |
| 201 | Magazine |
| 301 | Station |
| 303 | Ink tank |
| 304 | Compressed-gas tank |
| 305 | Fluid interface |
| 306 | Electronic interface |
| 307 | Mechanical interface |
| 308 | Purge tank |
| 309 | Platform (flange) |
| 310 | Frame |
| 320 | Movable connection assembly |
| 321 | Carriage |
| 322 | Rail |
| 324 | Column |
| 326 | Connection block |
| 328 | Jack |
| 331 | Channel |
| 341 | Channel |
| 360 | Control line |
| 361 | Central processing unit of 301 |
| 370 | Upper edge of 309 |
| 371 | Lower edge of 309 |
| 372 | Pin |
| 381 | Channel |
| 400 | Part to be decorated |
| 401 | Line of decoration |
| 402 | Raised decoration element |

DETAILED DESCRIPTION

The term "ink" is taken here in its broadest sense, in particular in relation to the inkjet printing technique, which is known to a person skilled in the art, and also includes varnishes of all kinds, which may be colored or not colored, transparent or opaque, and also includes protective varnishes.

As shown in FIGS. 1 to 4, the inkjet printing assembly according to the invention essentially comprises:

- at least one printing module. In the example shown, six printing modules denoted by reference signs 1A to 1F are provided, it being understood that a different number of these printing modules can be provided;
- a robot denoted as a whole by reference sign 101; and
- a magazine denoted as a whole by reference sign 201, in particular for immobilizing the aforementioned modules, as well as for emptying said modules and refilling them with fluids.

Figure 1B:
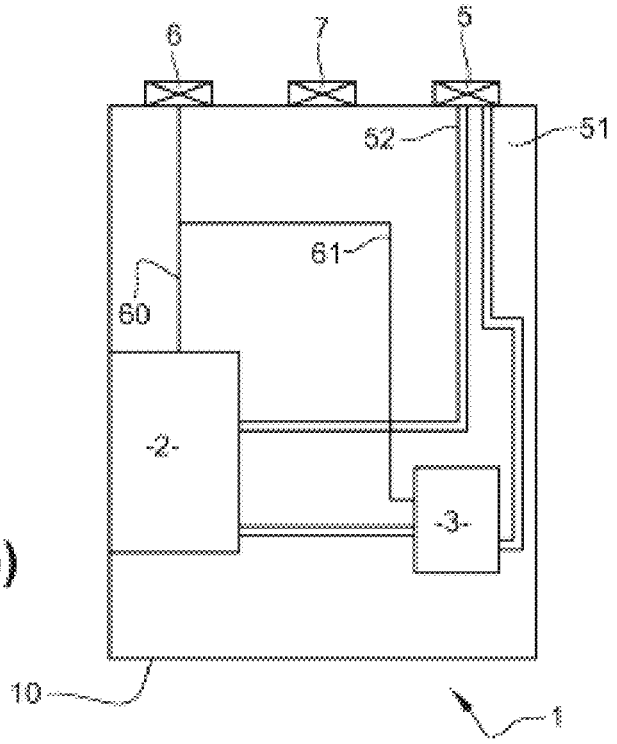

Firstly, the structure of one of the printing modules 1A will be described, it being understood that the other modules have an identical structure. With reference to FIG. 1(*a*), this module includes a housing 10 made of any suitable material, for example steel or plastics material. This housing, which is, for example, of parallelepiped shape, contains the various functional elements of the module.

First, there is a print head, denoted as a whole by reference sign 2. This print head, which is of a type known per se, is in particular provided with spray nozzles (not shown in the drawings) for spraying ink onto the work surface. According to the invention, the head 2 is first placed in communication with an ink reservoir 3, via a channel 31. It is also placed in communication with a compressed-gas supply, via a particular channel 41. Said compressed-gas supply may be a compressed-air reservoir 4, as in FIG. 1(*a*). These two reservoirs 3 and 4 are also placed in communication with a fluid interface 5, the function of which will be described in more detail in the following. 51 and 52 denote the respective channels that fluidically connect this interface and these reservoirs.

Alternatively, the compressed-gas reservoir is dispensed with, as shown in FIG. 1(*b*), and the fluid interface 5 is to be fed by an external compressed-gas supply, as will be explained below. In this case, the duct 52 communicates directly with the print head 2, possibly via a control element (not shown in the figure).

The printing module according to the invention is furthermore provided with an electronic interface 6, the function of which will be described in more detail below. Control lines 60, 61 and 62 connect this interface 60 to the print head 2 and the reservoirs 3 and 4, respectively. Finally, this module is provided with a mechanical interface 7, the function of will be discussed in more detail in the following.

In an alternative embodiment (not shown in the drawings), the ink reservoir 3 is removable and can be replaced when it is empty; in this case the ink supply means of the ink reservoir may be dispensed with, specifically the channel 51 which connects the ink reservoir and the fluid interface 5. In yet another alternative embodiment (not shown in the drawings), the ink reservoir and the print head form a single piece which is removable and which can be replaced when the ink reservoir is empty; as in the previous alternative embodiment, the ink supply means of the reservoir may then be dispensed with.

Figure 2:
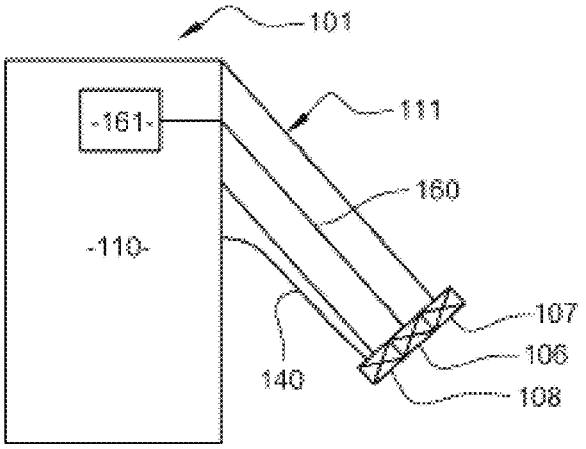
FIG. 2 is a schematic view showing more particularly a robot, also belonging to the printing assembly of FIG. 1, which robot is capable of engaging with the module of FIG. 1.

The structure of the robot 101 will now be described in more detail, with reference to FIG. 2. Said robot includes a body 110 forming a base, of any suitable type, as well as a gripper arm 111. The body 110 optionally comprises at least one additional arm so as to allow movement of the gripper arm in a plurality of spatial directions. Typically, robot 101 is of the six-axis type; these robots are known as such.

The arm 111 is provided, near its free end, with a mechanical interface referred to as a complementary mechanical interface 107. Said interface is capable of engaging with the mechanical interface 7 provided on the module 1. These two mechanical interfaces, which are of a type known per se, allow in particular removable fastening between the module and the robot. By way of non-limiting examples, these two interfaces define in particular a quick coupling, typically of the quarter-turn type. These quick-coupling mechanical interfaces, or mechanical couplings, are known to a person skilled in the art and are described, for example, in the ISO 11593 standard. In the context of the present invention, the presence of such an interface is essential, but its structure is irrelevant. It is possible, for example, to use a tool changing system for robots from the MPS range marketed by Stäubli.

The arm 111 is also provided, near its free end, with a complementary fluid interface 108 capable of engaging with the fluid interface 5 of the module 1. Said complementary fluid interface 108 is connected to an external compressed-gas supply, which is typically a flexible tube 140 extending along the arm 111 of the robot 101. This complementary fluid interface 108 is necessary only in the event that the module 1 does not have a compressed-gas reservoir and needs an external compressed-gas supply. These quick-coupling fluid interfaces, or fluid couplings are known to a person skilled in the art; their structure is irrelevant.

The robot is also provided with a central processing unit, which is shown schematically and is denoted generally by reference sign 161. This central processing unit is connected, via a control line 160, to an electronic interface referred to as a complementary electronic interface 106, which is capable of engaging with the electronic interface 6 of the module 1. These two electronic interfaces (or couplings), of a type known per se, allow data to be transferred from the unit 161 to the print head 2; these data can be represented by analog and/or digital signals.

It is therefore easy to see that the mechanical interface 7 of the module 1 is a coupling, preferably a quick-coupling coupling, designed so as to be able to engage with the complementary mechanical interface 107 of the arm 111 of the robot 101, and that the fluid interface 5 of the module 1 is a coupling, preferably a quick-coupling coupling, designed so as to be able to engage with the complementary fluid interface 108 of the arm 111 of the robot 101. Likewise, the electronic interface 6 of the module 1 is a coupling designed so as to be able to engage with the complementary electronic interface 106 of the arm 111 of the robot 101. When the two fluid interfaces 5, 108 are coupled, they allow the passage of fluid. In contrast, when these two interfaces are disconnected, each of said interfaces provides a seal for a particular fluid against the ambient air.

Figure 4:
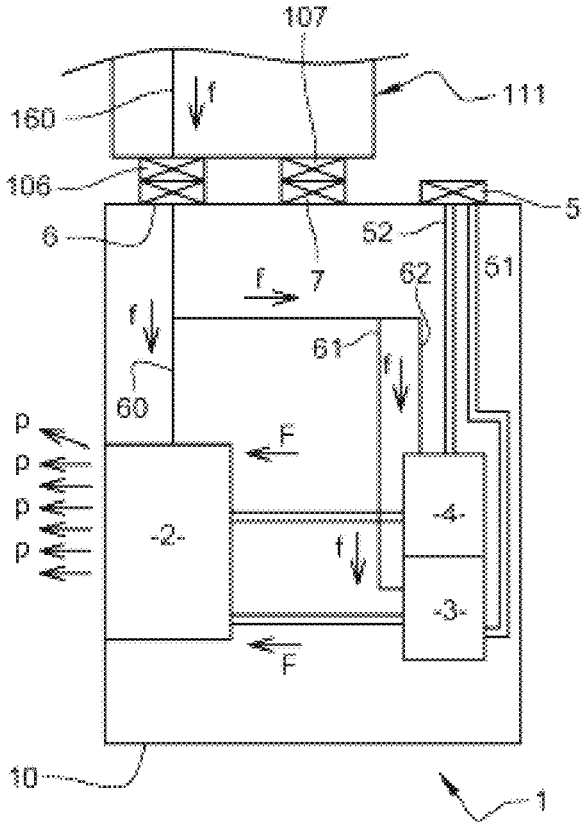
FIGS. 4 to 7 are schematic views showing different stages of the use of the printing assembly shown in the preceding figures.

FIG. 4 schematically shows this coupling between the two electrical interfaces 106 and 6, and between the two mechanical interfaces 107 and 7; in this example, the module 1 has its compressed-gas tank 4, and its fluid interface 5 does not need to be connected to a complementary interface of the arm 111 of the robot. An example for the structure of these different interfaces will be given below in relation to FIG. 9.

Figure 3:
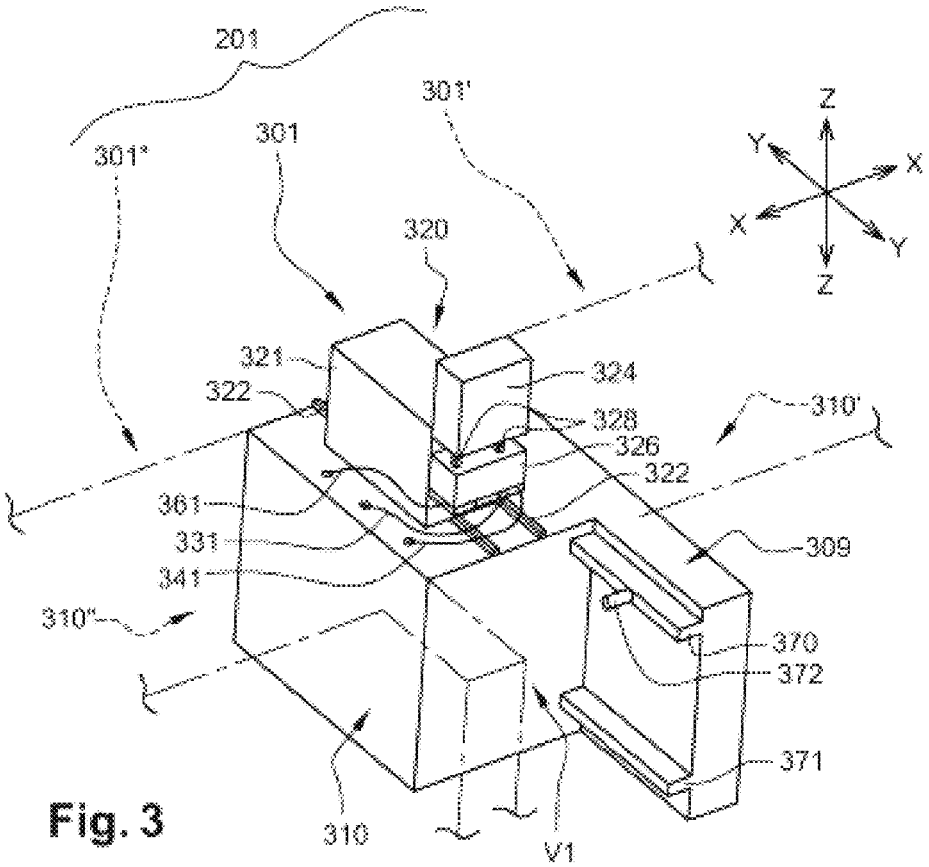
FIG. 3 is a perspective view showing a station capable of engaging with the module of FIG. 1, this station belonging to a magazine capable of engaging with a plurality of similar modules.

The structure of the magazine 201 will now be described in more detail with reference to FIG. 3. As shown in this FIG. 3, this magazine comprises a particular number of stations 301 for engaging with the modules 1 described above. Preferably, there are as many stations 301 as there are modules 1, i.e., in other words, each station is dedicated to a particular module. However, in an alternative embodiment, a different number of stations and modules can be provided. In this context, a given module can engage with a plurality of stations and/or a given station can engage with a plurality of modules. In this FIG. 3, a single station 301 is shown in detail, while stations 301' and 301", located immediately on either side of station 301, are shown only very schematically in phantom lines.

The structure of one of the stations will now be described, it being understood that the other stations typically have an identical structure. With reference to FIG. 3, this station 301 firstly includes a frame 310, of substantially parallelepiped shape, which contains various functional elements which will be described below. A platform or flange 309 for immobilizing a particular module projects forward from one of the lateral sides of the aforementioned frame. As shown in FIG. 3, the adjacent walls of the frame and of the flange define a volume, denoted by V1, for receiving a particular the module 1.

This flange is provided with mechanical means for holding the module in position when said module is immobilized. More precisely, this flange 309 is provided, for example, with upper and lower edges 370 and 371, respectively, for centering the module when it enters its receiving volume V1. Furthermore, the upper edge 370 is provided with a pin 372 for immobilizing the module relative to the flange. To this end, this module is, for example, provided with an opening (not shown) for engaging with the aforementioned pin, for example by resilient snap-fitting.

Figure 8:
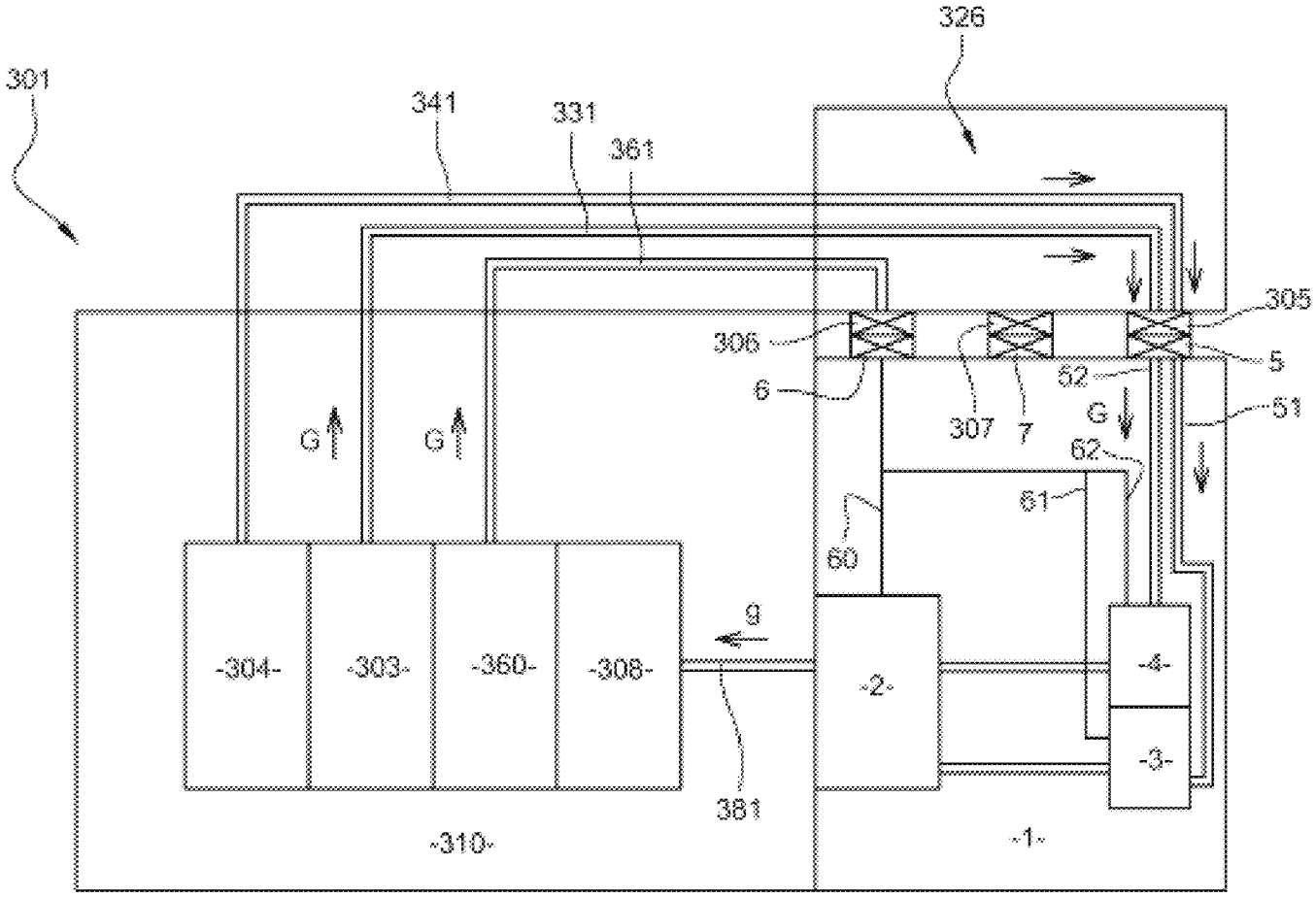
FIG. 8 is a schematic view showing more precisely the engagement between the fluid, mechanical and electronic interfaces of the module and the station of FIG. 3.

As shown in FIG. 8, a plurality of tanks for receiving different fluids is housed in the frame. There are, respectively, an ink tank 303, a compressed air tank 304, as well as a tank referred to as a purge tank 308, for receiving used ink. This ink tank 303 and the purge tank 308 may be dispensed with in the event that the module 1 uses an ink reservoir which is replaced when empty. Finally, the station 301 is provided with a central processing unit 360 which is capable in particular of controlling the activation of the various interfaces of the station, which interfaces will be described below.

The station 301 is furthermore provided with a movable connection assembly, denoted as a whole by reference sign 320. This assembly 320 firstly includes a carriage 321 that is movable relative to the frame 310 in the direction YY. To this end, the upper wall of the frame is provided, for example, with rails 322 that engage with gliding channels (not shown) provided in the carriage. The carriage is moved along these rails by motor means (not shown) of any suitable type.

The carriage 321 supports a column 324 that is stationary relative to this carriage and positioned in front of said carriage, specifically so as to face the storage volume of the module. This column in turn supports a connection block 326 that is movable relative to this column in the direction ZZ. For this purpose, for example, jacks 328 are provided, the body of which is rigidly connected to the column and the rod of which is rigidly connected to the block.

The connection block 326 is provided with a plurality of interfaces. First, there is a fluid interface 305 that is designed to be able to engage with that, 5, of the module 1. These two fluid interfaces, which are of a type known per se, allow a quick-coupling detachable connection to be established between the module 1 and the station 301. When these two interfaces are coupled, said connection allows the passage of fluid between this module and this station. In contrast, when these two interfaces are disconnected, each of said interfaces provides a seal for a particular fluid against the ambient air.

The interface 305 is connected to reservoirs 303 (if present) and 304 by respective channels 331 and 341 (see FIG. 8). Furthermore, an additional connecting channel 381 can be provided that connects the print head 2 and the purge tank 308. This channel 381, which can be removably coupled to this print head, is associated with a vacuum source (not shown).

The connection block 326 is also provided with two additional interfaces, respectively electronic 306 and mechanical 307. These interfaces 306 and 307 are similar to those 106 and 107 described above that are provided on the arm 111 of the robot. The electronic interface 306 is connected, via a control line 361, to the central processing unit 360 (see FIG. 8).

Figure 9:
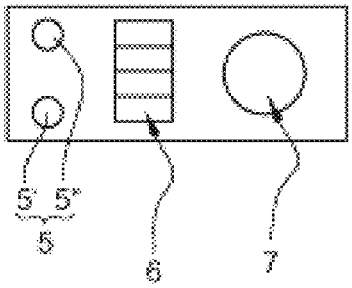
FIG. 9 is a top view showing more particularly the different interfaces of the module of FIG. 3.
Figure 10:
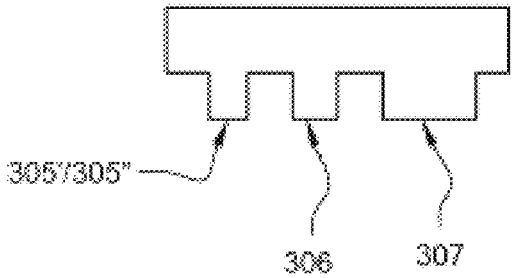
FIG. 10 is a side view showing more particularly the different interfaces of the station of FIG. 3.

FIGS. 9 and 10 show, by way of example, one possible embodiment of the various interfaces, provided on the module and the station, respectively.

As shown in FIG. 9. the fluid interface 5 of the module is formed by two female-type coupler elements 5' and 5" for the circulation of compressed gas and ink, respectively. Furthermore, as shown in FIG. 10, the fluid interface 305 of the station is formed by two male-type coupler elements 305' and 305" for engaging with the coupler elements 5' and 5".

In addition, as shown in FIG. 9, the electronic interface 6 of the module is formed by a female-type connector element. Moreover, as shown in FIG. 10, the electronic interface 306 of the station is formed by a male-type connector element for engaging with the female connector 6.

Finally, as shown in FIG. 9, the mechanical interface 7 of the module is formed by a female-type quick coupling. Moreover, as shown in FIG. 10, the mechanical interface 307 of the station is formed by a male-type connector element for engaging with the female quick coupling 7.

It should be noted that the structure of the electronic interface 106 and the mechanical interface 107 provided on the robot have not been described in more detail. Typically, these interfaces are analogous to those 306 and 307 provided on the station, as described with reference to FIG. 9.

The use of the printing assembly described above will now be described with reference to FIGS. 4 to 8.

Firstly, it is assumed, with reference to FIG. 4. that the reservoirs 3 and 4 are filled with ink and compressed air, respectively. The two interface pairs, 6 and 106, and 7 and 107, respectively, are brought into engagement. Consequently, the robot and the module are connected electronically, specifically the central processing unit 161 is capable of controlling the various components of the module via lines 160, 60, 61 and 62, which is indicated by the arrows f. Moreover, this robot and this module are mechanically rigidly connected to one another due to the interfaces 7 and 107.

The robot thus controls the print head 2 so as to spray the ink on the target surface, as indicated by the arrows p. In the course of this spraying, additional ink and air are admitted into the head 2 from the reservoirs 3 and 4, as indicated by the arrows F. During this printing operation, the station 301 does not engage with the module 1. In other words, as shown in FIG. 3, the storage volume V1 is empty.

At the end of this printing operation, the reservoirs 3 and 4 are now empty. Said reservoirs now need to be refilled, which is shown in FIGS. 5 to 8. The arm 111 first directs the module 1 to the storage volume so as to dock this module on the flange 309. The module is immobilized, relative to this flange, in particular by the pin 372. The interfaces 7 and 107 are then disconnected so that the arm can be withdrawn.

Figure 5:
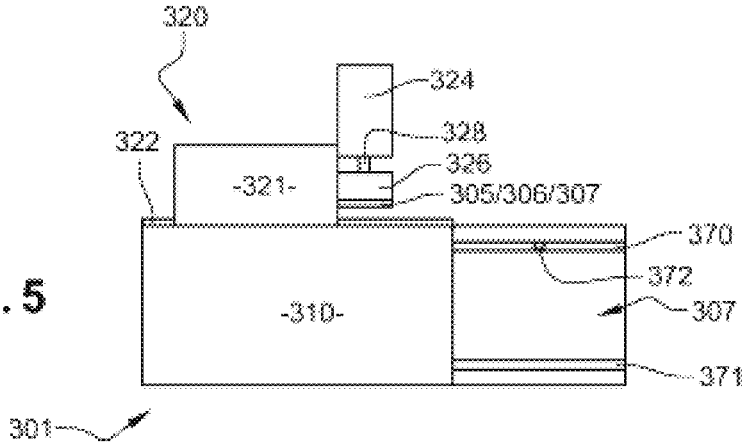
Figure 6:
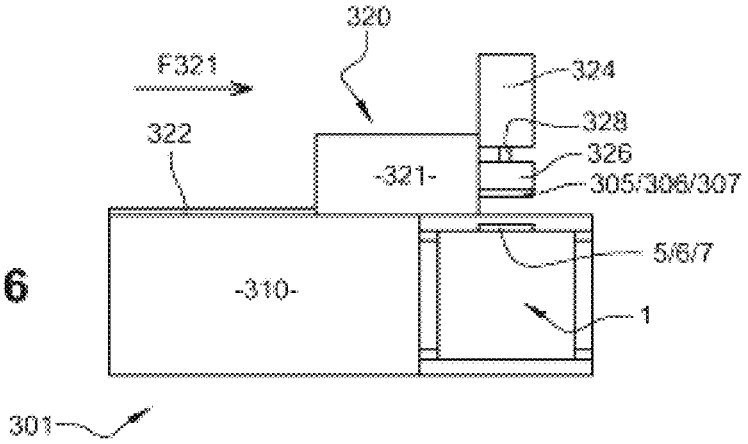
Figure 7:
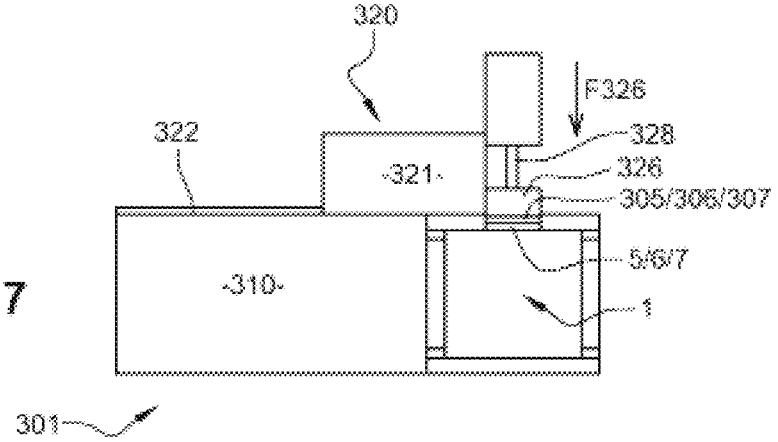

When docking the module on the flange, as can be seen in FIG. 5, the movable assembly is in a position referred to as an inoperative position, i.e., the connection block cannot engage with the module. This movable assembly is then moved, in two successive stages. The first step is to move the carriage horizontally, toward the storage area, in the direction of the arrow F321. As shown in FIG. 6, the connection block 326 is now located directly above the module, while being spaced apart therefrom.

This block is then moved vertically downward, in the direction of the arrow F326, so as to make the connection block and the module engage. In this operative position of the movable assembly shown in FIG. 7, there is mutual engagement between the mechanical interfaces 7 and 307, between the fluid interfaces 5 and 305, as well as between the electronic interfaces 6 and 306.

As shown in FIG. 8, which shows only the frame 310, the block 326 and the module 1, the central processing unit 360 thus controls the filling of the reservoirs 3 and 4 from the respective tanks 303 and 304, which is indicated by the arrows G. In addition, the purge line 381 is coupled to the print head 2. A cleaning solvent is injected into the inner volume of the head from a solvent reservoir (not shown). The used ink, initially present in this head, is then sucked out of this head in order to be discharged to the reservoir 308 in the direction of the arrow g. This purging operation prevents the print head 1 from becoming clogged with dried ink during its inoperative period.

The module 1 is operational again in readiness for an additional printing operation, which is carried out in a manner analogous to that which has been described above. It may be noted that, during the refilling of the module 1, the robot 101 can pick up another module in order to implement another printing operation. Therefore, the printing assembly according to the invention can work in masked time.

Advantageously, the tanks 303 belonging to different stations are filled with inks of different types. In this case, each tank is intended for feeding a dedicated print head in order to spray a specific ink on the target surface. Within the meaning of the invention, different types of inks can mean that the inks have different colors and/or different physicochemical characteristics (such as viscosity or density) and/or different appearances (such as gloss).

In the example described and shown, each station is provided with a compressed-gas tank. However, in an alternative embodiment, a single compressed-gas tank having a greater volume can be provided for the entire magazine. In this case, this single tank is connected to the fluid interface of each station, via a particular pipe. It is also possible that neither the stations nor the magazine includes an air tank, but that the compressed-gas supply comes from an external line connected to the magazine.

The invention has many advantages. Owing to the self-contained nature of the ink (and possibly compressed-gas) printing modules 1, the movements of the robot 101 according to the invention are not impeded by the presence of flexible tubes and cables; this simplifies the design, programming and use of the robot.

The robot 101 according to the invention can be used for the inkjet deposition of protective inks and/or varnishes on the surface of three-dimensional parts. These surfaces can have a decimetric or metric dimension; their largest dimension may thus be, for example, between approximately 2 dm and approximately 2 m. These surfaces can be curved, and can also include a surface structure, for example on a millimeter scale.

By way of example, this robot can be used to decorate trim pieces for the passenger compartment of an automobile. These trim pieces can be, for example, dashboards or door trim pieces; their largest dimension can typically be between 3 dm and 1.5 m. These parts can be manufactured according to methods known as such, for example by forming a PVC coating having a decorative surface appearance on a substrate (core); such a method is described in WO 98/00277 (Elf Atochem S. A.). These parts may have mock seams, the surface of which typically exhibits details at a scale of approximately 0.1 mm to 20 mm. The robot according to the invention allows these details to be decorated by inkjet.

Figure 11:
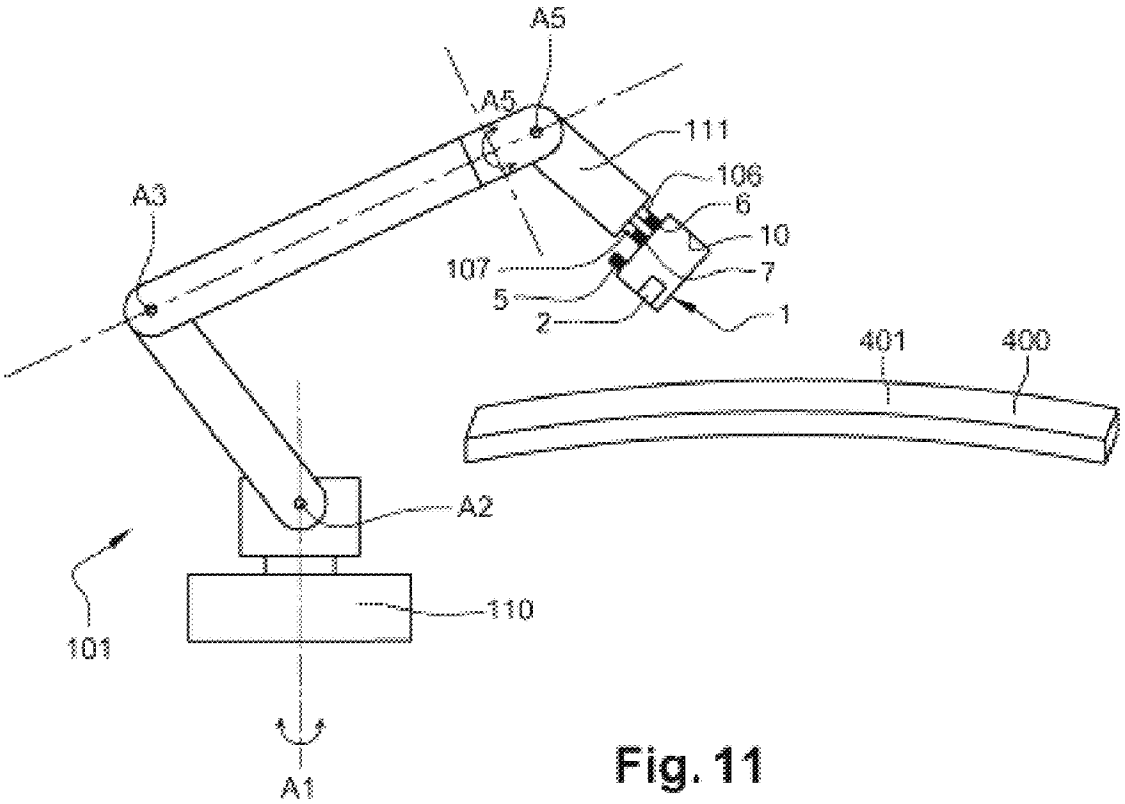
FIG. 11 is a schematic view of an inkjet printing assembly, including the inkjet module mounted on a five-axis robot according to the invention.

FIG. 11 schematically shows an inkjet printing assembly according to the invention, including the inkjet printing module 1 mounted on a five-axis robot 101; the axes are denoted by the reference signs A1 to A5. The printing module 1 is moved above the surface to be decorated of the part 400 to be decorated; in this case, this surface is curved, and the decoration includes a line 401 which may or may not be straight, and which may or may not be continuous, and which may or may not lie on a ridge of the curved surface. This line may be raised, and/or may comprise raised decorations, as shown in FIG. 12.

Figure 12A:
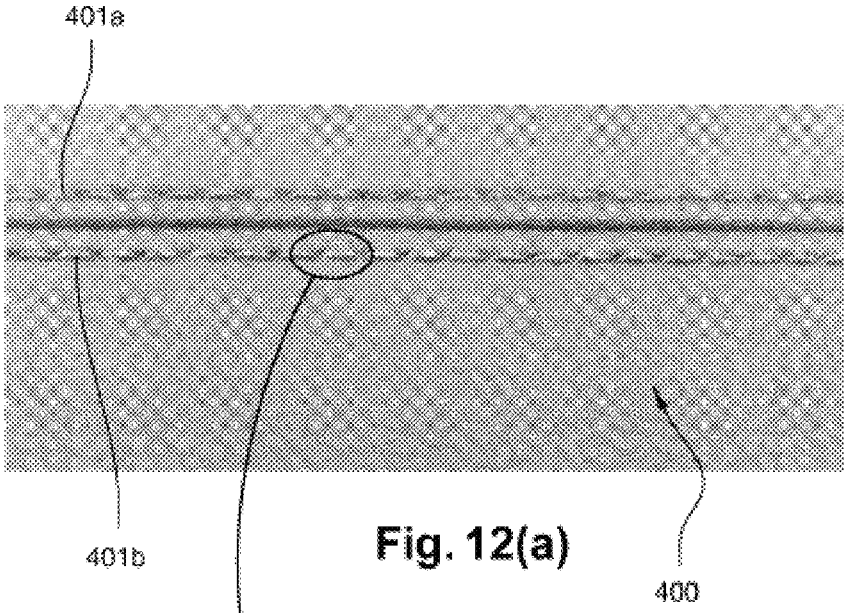
FIG. 12(*a*) is a photograph showing a trim piece for an automobile passenger compartment, which piece is decorated by a printing method according to the invention.
Figure 12B:
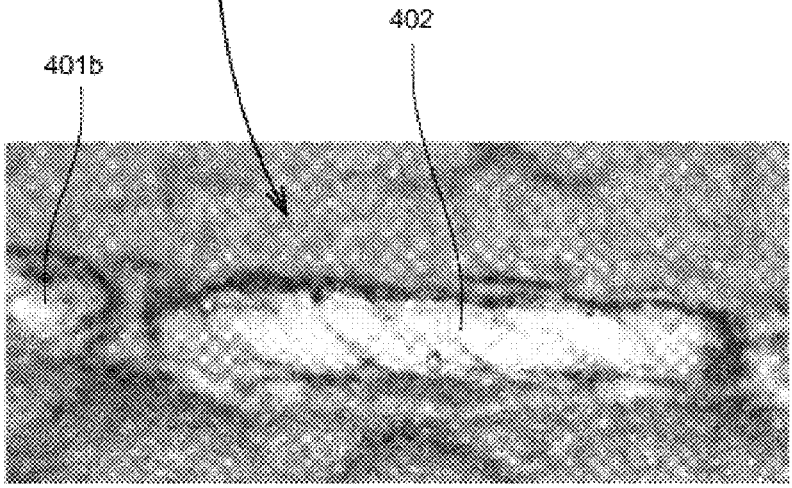

FIG. 12 shows a photograph of part of the surface of a part 400 to be decorated, in this case a trim part for an automobile passenger compartment. This surface includes "artificial leather" graining. It comprises artificial seams arranged along two lines 401*a*, 401*b*, which include raised decoration elements 402. The method according to the invention makes it possible in particular to deposit ink of the desired color on these raised decoration elements, excluding the surrounding area; in other words, the ink covers only these raised decoration elements. The positioning precision of the ink on these raised decoration elements can be as much as 0.10 mm, with an ink drop diameter of approximately 80 μm.

The ink can be deposited in one or more passes. Decoration by inkjet can be completed by depositing a transparent varnish, also by inkjet. Since the magazine for inkjet printing modules according to the invention can comprise a plurality of inkjet printing modules each comprising a different ink, it is easy, after the decoration by a jet of ink of a desired color, to deposit a transparent varnish; this can be carried out by exchanging the module comprising the ink for another module comprising the varnish. Likewise, it is easy to use a different ink for the next part to be decorated. The invention thus gives the manufacturer of decorated parts a high degree of flexibility, which responds to customer demand to customize objects.

The invention claimed is:

1. An inkjet printing module capable of being picked up by the arm of a robot via a quick-coupling mechanical interface, characterized in that said module includes:

a print head;

an ink reservoir capable of supplying ink to said print head;

compressed-gas supply means capable of supplying compressed gas to said print head;

a mechanical interface capable of engaging removably with a complementary mechanical interface of a robot arm;

an electronic interface capable of engaging removably with an electronic interface of said robot arm in order to transfer data between said module and the robot; and at least one fluid interface placed in fluid communication with the compressed-gas supply means and/or with the ink reservoir.

2. The module according to claim 1, characterized in that said compressed-gas supply means include a compressed-gas reservoir integrated into said module.

3. The module according to claim 1, characterized in that said ink reservoir includes said compressed-gas reservoir.

4. The module according to claim 1, characterized in that it includes one or two connecting pipes extending between the fluid interface and/or, respectively, the ink reservoir and the compressed-gas supply means.

5. A robot for inkjet printing, including a robot arm, characterized in that said robot arm includes:

a quick-coupling complementary mechanical interface capable of engaging with the quick-coupling mechanical interface of an inkjet printing module according to claim 1; and a complementary electronic interface capable of engaging with the electronic interface of an inkjet printing module.

6. The robot according to claim 5, characterized in that it includes a central processing unit, as well as at least one control line connecting this central processing unit and the complementary electronic interface.

7. The robot according to claim 5, characterized in that it is a five-axis robot or a six-axis robot.

8. An inkjet printing assembly, including a robot according to claim 5, a magazine, as well as at least one module.

9. The printing assembly according to claim 8, characterized in that the mechanical interface and the complementary mechanical interface define a removable quick coupling, in particular of the quarter-turn type.

10. A magazine for inkjet printing modules, the magazine being capable of accommodating, docked thereon, a plurality of inkjet printing modules according to claim 1, said magazine including:

a plurality of docking stations for an inkjet printing module, each docking station including at least one complementary fluid interface capable of engaging with the fluid interface of an ink jet printing module in order to transfer ink between the head and the docking station and/or to supply compressed gas to the head;

at least one ink tank;

at least one compressed-gas supply, which may be a compressed-gas tank; as well as at least one complementary mechanical interface capable of engaging with the mechanical interface of an inkjet printing module.

11. The magazine according to claim 10, characterized in that each station includes a frame containing said at least one ink tank and/or said at least one compressed-gas tank.

12. The magazine according to claim 10, characterized in that it includes a movable assembly provided with said complementary mechanical interface, and, where appropriate, with said complementary fluid interface and/or with said complementary electronic interface.

13. The magazine according to claim 12, characterized in that said movable assembly includes a carriage capable of being moved relative to the frame in a first direction, in particular a horizontal direction, as well as a connection block capable of being moved relative to the carriage in a second direction, in particular a vertical direction, said connection block being provided with said complementary mechanical interface, and, where appropriate, with said complementary fluid interface and/or with said complementary electronic interface.

14. The magazine according to claim 13, characterized in that each station further includes an immobilization flange extending from the frame, said flange and the frame defining a volume (V1) for receiving a module, said flange and/or the frame being provided with means for immobilizing said module.

15. An inkjet printing method, comprising the following steps:

(i) picking up an inkjet printing module according to claim 1 which is located in a docking station of a magazine that can contain a plurality of said modules, said picking up being carried out by means of engagement between said complementary mechanical interface of the robot and said mechanical interface of said module;

(ii) connecting the complementary electronic interface of said robot with the electronic interface of said module;

(iii) moving the robot arm to a print surface;

(iv) printing ink on said surface by moving the robot arm, in one or more passes, said module being controlled by data sent thereto by way of said electronic interface and said complementary electronic interface;

(v) at the end of this printing sequence, moving the robot arm to a docking station; and (vi) depositing the print head in said docking station, disconnecting said electronic and mechanical interfaces (vii) moving the robot arm to another docking station; and (viii) performing steps (i) to (vi) using another inkjet print head located in this docking station.

16. The method according to claim 15, characterized in that said robot is a robot for inkjet printing, including a robot arm, said robot arm including:

a quick-coupling complementary mechanical interface capable of engaging with the quick-coupling mechanical interface of an inkjet printing module; and a complementary electronic interface capable of engaging with the electronic interface of an inkjet printing module.

17. The method according to claim 15, characterized in that said magazine is a magazine for inkjet printing modules, the magazine being capable of accommodating, docked thereon, a plurality of inkjet printing modules, said magazine including:

a plurality of docking stations for an inkjet printing module, each docking station including at least one complementary fluid interface capable of engaging with the fluid interface of an ink jet printing module in order to transfer ink between the head and the docking station and/or to supply compressed gas to the head;

at least one ink tank;

at least one compressed-gas supply, which may be a compressed-gas tank; as well as at least one complementary mechanical interface capable of engaging with the mechanical interface of an inkjet printing module.

18. The method according to claim 15, further including refilling said ink reservoir of the module with ink by connecting the fluid interface of said module and the complementary fluid interface of said station.

19. The method according to claim 18, wherein the ink printing step (iv) is carried out using a first module while at least one other module is being refilled.

* * * * *